US007184953B2

(12) United States Patent
Jabri et al.

(10) Patent No.: US 7,184,953 B2
(45) **Date of Patent: *Feb. 27, 2007**

(54) TRANSCODING METHOD AND SYSTEM BETWEEN CELP-BASED SPEECH CODES WITH EXTERNALLY PROVIDED STATUS

(75) Inventors: Marwan A. Jabri, Broadway (AU); Jianwei Wang, Killarney Heights (AU); Stephen Gould, Woollahra (AU)

(73) Assignee: Dilithium Networks Pty Limited (AU)

( * ) Notice: Subject to any disclaimer, the term of this patent is extended or adjusted under 35 U.S.C. 154(b) by 0 days.

This patent is subject to a terminal disclaimer.

(21) Appl. No.: 10/928,416

(22) Filed: Aug. 27, 2004

(65) Prior Publication Data

US 2005/0027517 A1 Feb. 3, 2005

Related U.S. Application Data

(63) Continuation of application No. 10/339,790, filed on Jan. 8, 2003, now Pat. No. 6,829,579.

(60) Provisional application No. 60/421,270, filed on Oct. 25, 2002, provisional application No. 60/421,449, filed on Oct. 25, 2002, provisional application No. 60/421,446, filed on Oct. 25, 2002, provisional application No. 60/364,403, filed on Mar. 12, 2002, provisional application No. 60/347,270, filed on Jan. 8, 2002.

(51) Int. Cl.
*G10L 19/14* (2006.01)

(52) U.S. Cl. ..... 704/221; 704/219

(58) Field of Classification Search ..... 704/219–223, 704/201
See application file for complete search history.

(56) References Cited

U.S. PATENT DOCUMENTS

| | | | | |
|---|---|---|---|---|
| 5,457,685 | A | 10/1995 | Champion | |
| 5,519,779 | A * | 5/1996 | Proctor et al. | 380/34 |
| 5,758,256 | A | 5/1998 | Berry et al. | |
| 5,995,923 | A | 11/1999 | Mermelstein et al. | |
| 6,604,070 | B1 | 8/2003 | Gao et al. | |
| 6,661,360 | B2 * | 12/2003 | Lambert | 341/131 |

(Continued)

FOREIGN PATENT DOCUMENTS

GB 232130 A 6/1999

(Continued)

*Primary Examiner*—Donald L. Storm
(74) *Attorney, Agent, or Firm*—Townsend and Townsend and Crew LLP

(57) ABSTRACT

An apparatus for processing CELP-based frames includes a first module for extracting a CELP parameter from a source codec, a second module coupled to the first module adapted to interpolate between a CELP parameter of the source codec and a destination codec, the CELP parameter being selected from a group consisting of a frame size, a subframe size, and a sampling rate, a third module coupled to the second module adapted to map the CELP parameter from the source codec to a CELP parameter of the destination codec, a fourth module coupled to the third module adapted to construct a destination output CELP frame based upon the CELP parameter from the destination codec, and a controller coupled the first, second, third and fourth modules, adapted to oversee an operation of the modules, adapted to receive instructions from an external application, and adapted to provide status information to the external application.

16 Claims, 14 Drawing Sheets

U.S. PATENT DOCUMENTS 6,829,579 B2 * 12/2004 Jabri et al. ..... 704/221
2002/0196762 A1 12/2002 Choi et al.
2003/0028386 A1 2/2003 Zinser Jr. et al.
2004/0158647 A1 8/2004 Omura
2005/0053130 A1 * 3/2005 Jabri et al. ..... 375/240

FOREIGN PATENT DOCUMENTS

WO WO 00/48170 A1 8/2000

* cited by examiner

TRANSCODING METHOD AND SYSTEM BETWEEN CELP-BASED SPEECH CODES WITH EXTERNALLY PROVIDED STATUS

CROSS-REFERENCES TO RELATED APPLICATIONS

This present application claims priority to U.S. Provisional Applications 60/347,270, filed Jan. 8, 2002, 60/364,403, filed Mar. 12, 2002, 60/421,446, filed Oct. 25, 2002, 60/421,449, filed Oct. 25, 2002, and 60/421,270, filed Oct. 25, 2002, commonly owned, and hereby incorporated by reference for all purposes.

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK.

NOT APPLICABLE

BACKGROUND OF THE INVENTION

The present invention generally relates to techniques for processing information. More particularly, the invention provides a method and apparatus for converting CELP frames from one CELP based standard to another CELP based standard, and/or within a single standard but a different mode. Further details of the present invention are provided throughout the present specification and more particularly below.

Coding is the process of converting a raw signal (voice, image, video, etc) into a format amenable for transmission or storage. The coding usually results in a large amount of compression, but generally involves significant signal processing to achieve. The outcome of the coding is a bitstream (sequence of frames) of encoded parameters according to a given compression format. The compression is achieved by removing statistically and perceptually redundant information using various techniques for modeling the signal. Hence the encoded format is referred to as a "compression format" or "parameter space". The decoder takes the compressed bitstream and regenerates the original signal. In the case of speech coding, compression typically leads to information loss.

The process of converting between different compression formats and/or reducing the bit rate of a previously encoded signal is known as transcoding. This may be done to conserve bandwidth, or connect incompatible clients and/or server devices. Transcoding differs from the direct compression process in that a transcoder only has access to the compressed signal and does not have access to the original signal.

Transcoding can be done using brute force techniques such as "tandem" which has a decompression process followed by a re-compression process. Since large amount of processing is often required and delays may be incurred to decompress and then re-compress a signal, one can consider transcoding in the compression space or parameter space. Such transcoding aims at mapping between compression formats while remaining in the parameter space wherever possible. This is where the sophisticated algorithms of "smart" transcoding come into play. Although there has been advances in transcoding, it is desirable to further improve transcoding techniques. Further details of limitations of conventional techniques will be described more fully throughout the present specification and more particularly below.

BRIEF SUMMARY OF THE INVENTION

According to a the present invention, techniques for processing information are provided. More particularly, the invention provides a method and apparatus for converting CELP frames from one CELP based standard to another CELP based standard, and/or within a single standard but a different mode. Further details of the present invention are provided throughout the present specification and more particularly below.

In a specific embodiment, the invention provides an apparatus for converting CELP frames from one CELP-based standard to another CELP based standard, and/or within a single standard but to a different mode. The apparatus has a bitstream unpacking module for extracting one or more CELP parameters from a source codec. The apparatus also has an interpolator module coupled to the bitstream unpacking module. The interpolator module is adapted to interpolate between different frame sizes, subframe sizes, and/or sampling rates of the source codec and a destination codec. A mapping module is coupled to the interpolator module. The mapping module is adapted to map the one or more CELP parameters from the source codec to one or more CELP parameters of the destination codec. The apparatus has a destination bitstream packing module coupled to the mapping module. The destination bitstream packing module is adapted to construct at least one destination output CELP frame based upon at least the one or more CELP parameters from the destination codec. A controller is coupled to at least the destination bitstream packing module, the mapping module, the interpolator module, and the bitstream unpacking module. Preferably, the controller is adapted to oversee operation of one or more of the modules and being adapted to receive instructions from one or more external applications. The controller is adapted to provide a status information to one or more of the external applications.

In an alternative specific embodiment, the invention provides a method for transcoding a CELP based compressed voice bitstream from source codec to destination codec. The method includes processing a source codec input CELP bitstream to unpack at least one or more CELP parameters from the input CELP bitstream and interpolating one or more of the plurality of unpacked CELP parameters from a source codec format to a destination codec format if a difference of one or more of a plurality of destination codec parameters including a frame size, a subframe size, and/or sampling rate of the destination codec format and one or more of a plurality of source codec parameters including a frame size, a subframe size, or sampling rate of the source codec format exist. The method includes encoding the one or more CELP parameters for the destination codec and processing a destination CELP bitstream by at least packing the one or more CELP parameters for the destination codec.

In an alternative specific embodiment, the invention provides a method for processing CELP based compressed voice bitstreams from source codec to destination codec formats. The method includes transferring a control signal from a plurality of control signals from an application process and selecting one CELP mapping strategy from a plurality of different CELP mapping strategies based upon at least the control signal from the application. The method also includes performing a mapping process using the selected CELP mapping strategies to map one or more CELP parameters from a source codec format to one or more CELP parameters of a destination codec format.

Still further, the invention provides a system for processing CELP based compressed voice bitstreams from source codec to destination codec formats. The system includes one or more memories. Such memories may include one or more codes for receiving a control signal from a plurality of control signals from an application process. One or more codes for selecting one CELP mapping strategy from a plurality of different CELP mapping strategies based upon at least the control signal from the application are also included. The one or more memories also include one or more codes for performing a mapping process using the selected CELP mapping strategies to map one or more CELP parameters from a source codec format to one or more CELP parameters of a destination codec format. Depending upon the embodiment, there may also be other computer codes for carrying out the functionality described herein, as well as outside of this specification, which may be combined with the present invention.

Numerous benefits are achieved using the present invention. Depending upon the embodiment, one or more of these benefits may be achieved.

To reduce the computational complexity of the transcoding process.

To reduce the delay through the transcoding process.

To reduce the amount of memory required by the transcoding.

To introduce dynamic rate control

To support silence frames through an embedded voice activity detector.

To provide a framework where various parameter mapping strategies can be used.

To provide a generic transcoding architecture to adapt the current and future diversity CELP based codecs.

The transcoding invention may achieve one or more of these benefits. In a specific embodiment, the transcoding apparatus includes:

a source CELP parameter unpacking module that extracts CELP parameters from the input encoded CELP bitstream;

a CELP parameter interpolator that converts the input source CELP parameters into destination CELP parameters corresponding to the subframe size difference between source and destination codec; Parameter interpolation is used if the subframe size of source and destination codecs are different.

a destination CELP parameter mapping and tuning engine that converts CELP parameters from the said interpolator module into the destination CELP codec parameters;

a destination CELP codes packer that packs the mapped CELP parameters into destination CELP code frames;

an advanced feature manager that manages optional functions and features in CELP-to-CELP transcoding;

a controller that oversees the overall transcoding process;

a status reporting function that provides the status of the transcoding process.

The source CELP parameter unpacking module is a simplified CELP decoder without a formant filter and a post-filter.

The CELP parameter interpolator comprises of a set of interpolators related to one or more of the CELP parameters.

The destination CELP parameter mapping and tuning module includes a parameter mapping strategy switching module, and one or more of the following parameter mapping strategies: a module of CELP parameter direct space mapping, a module of analysis in excitation space mapping, a module of analysis in filtered excitation space mapping.

The invention performs transcoding on a subframe by subframe basis. That is, as a frame (of source compressed information) is received by the transcoding system, the transcoder can begin operating on it and producing output subframes. Once a sufficient number of subframes have been produced, a frame (of compressed information according to destination format) can be generated and can be sent to the communication channel if communication is the purpose. If storage is the purpose, the generated frame can be stored as desired. If the duration of the frames defined by the source and destination format standards are the same, then a single incoming frame will produce a single outgoing frame, otherwise buffering of either input frames, or generation of multiple output frames will be needed. If the subframes are of different durations, then interpolation between the subframe parameters will be required. Thus the transcoding operation consists of four operations: (1) bitstream unpacking, (2) subframe buffering and interpolation of source CELP parameters, (3) mapping and tuning to destination CELP parameters, and (4) code packing to produce output frame(s).

So on receipt of a frame, the transcoders unpack the bitstream to produce the CELP parameters for each of the subframes contained within the frame (FIG. 10, block (1)). The parameters of interest are the LPC coefficients, the excitation (produced from the adaptive and fixed codewords), and the pitch lag. Note that for a low complexity solution that produces good quality, only decoding to the excitation is required and not full synthesis of the speech waveform. If subframe interpolation is needed, it is done at this point by smart interpolation engine (FIG. 10, block (2)).

The subframes are now in a form amenable for processing by the destination parameter mapping and tuning module (FIG. 10, block (5)). The short-term LPC filter coefficients are mapped independently of the excitation CELP parameters. Simple linear mapping in the LSP pseudo-frequency space can be used to produce the LSP coefficients for the destination codec. The excitation CELP parameters can be mapped in a number of ways giving accordingly better quality output at the cost of computational complexity. Three such mapping strategies have been described in this document and are part of the Parameter Mapping & Tuning Strategies module (FIG. 10, block (4)):

CELP parameter Direct Space Mapping (DSM);

Analysis in excitation space domain;

Analysis in filtered excitation space domain

The selection of the mapping and tuning strategy is through the Mapping & Tuning Strategy Switching Module (FIG. 10, block (3)).

Since the three methods trade-off quality for reduced computational load, they can be used to provide graceful degradation in quality in the case of the apparatus being overloaded by a large number of simultaneous channels. Thus the performance of the transcoders can adapt the available resources. Alternatively a transcoding system may be built using one strategy only yielding a desired quality and performance. In such a case, the Mapping and Tuning Strategy Switching module (FIG. 10, Block (3)) would not be incorporated.

A voice activity detector (operating in the parameter space) can also be employed at this point, if applicable to the destination standard, to reduce the outbound bandwidth.

The mapped parameters can then be packed into destination bitstream format frames (FIG. 10, block (7)) and generated for transmission or storage.

The invention covers the algorithms and methods used to perform smart transcoding between CELP-based speech coding standards. The invention also covers transcoding within a single standard in order to perform rate control (by transcoding to lower modes or introduce silence frames through an embedded Voice Activity Detector).

The whole procedure of transcoding is overseen by a Control module (FIG. 10, block (8)) which sends command based on the status of transcoding and external instructions.

In order to adapt different transcoding requirements, the apparatus of the present invention provides the capabilities of adding optional features and functions (FIG. 10, block (6)).

Other features and advantages of the present invention will be apparent from the following description taken in conjunction with the accompanying drawing, in which like reference characters designate the same or similar parts throughout the figures thereof.

BRIEF DESCRIPTION OF THE DRAWINGS

The objects, features, and advantages of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE INVENTION

Figure 1:
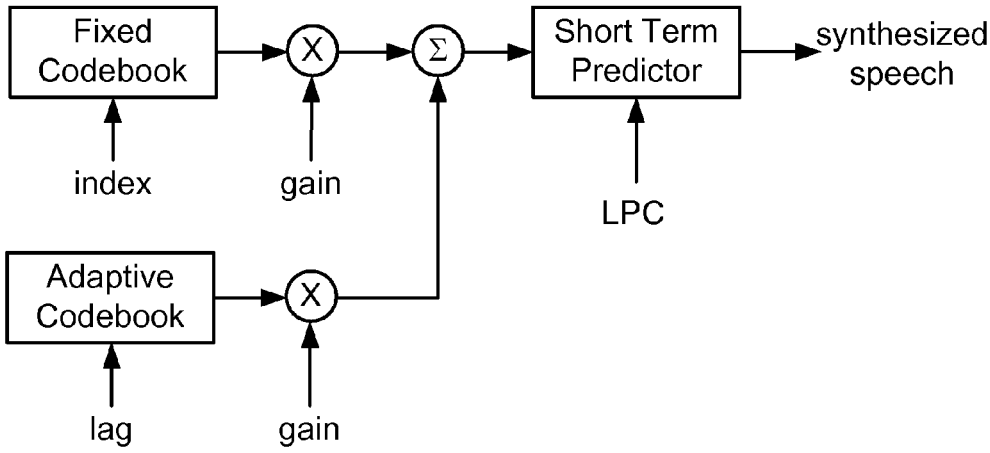
FIG. 1 PRIOR ART
FIG. 1 is a simplified block diagram of the decoder stage of a generic CELP coder.

According to a the present invention, techniques for processing information are provided. More particularly, the invention provides a method and apparatus for converting CELP frames from one CELP based standard to another CELP based standard, and/or within a single standard but a different mode. Further details of the present invention are provided throughout the present specification and more particularly below.

The invention covers algorithms and methods used to perform smart transcoding between CELP (code excited linear prediction) based coding methods and standards. Of most interest are the CELP coding methods standardized by bodies such as the International Telecommunication Union (ITU) or the European Telecommunications Standards Institute (ETSI). The invention also covers transcoding within a single standard in order to perform rate control (by transcoding to lower modes or introduce silence frames through an embedded Voice Activity Detector).

Speech coding techniques in general can be classified as waveform coders (e.g. standards G.711, G.726, G.722 from the ITU) and analysis-by-synthesis (AbS) type of coders (e.g. G.723.1 and G.729 standards from the ITU, GSM-AMR standard from ETSI, and Enhanced Variable-Rate Codec (EVRC), Selectable Mode Vocoder (SMV) standards from the Telecommunication Industry Association (TIA)). Waveform coders operate in the time domain and they are based on sample-by-sample approach that utilizes the correlation between speech samples. Analysis-by-synthesis coders try to imitate the human speech production system by a simplified model of a source (glottis) and a filter (vocal tract) that shapes the output speech spectrum on frame basis (typically frame size of 10–30 ms is used).

The analysis-by-synthesis types of coders were introduced to provide high quality speech at low bit rates, at the expense of increased computational requirements. Compression techniques are a meaningful way to save the resource in the communication interface.

Mathematically, all speech codecs start with a one-dimensional analog speech signal, $x_\alpha(t)$, which is uniformly sampled and quantised to get a digital domain representation, $x(n)=Q(x_\alpha(nT))$. The sampling rate, $$f = \frac{1}{T},$$

for speech signals is normally either 8 kHz or 16 kHz, and the sampled signal is quantised to a maximum typically of 16-bits.

A CELP-based codec can then be thought of as an algorithm which maps between the sampled speech, x(n), and some parameter space, θ, using a model of speech production, i.e. it encodes and decodes the digital speech. All CELP-based algorithms operate on frames of speech (which may be further divided into several subframes). In some codecs the speech frames overlap each other. A frame of speech can be defined as a vector of speech samples beginning at some time n, that is, $$\tilde{x}_i=[x(n)x(n+1)\ \ldots\ x(n+L-1)]^T$$

where L is the length (number of samples) of the speech frame. Note that the frame index, i, is related to the first frame sample n by a linear relationship, $$n=\begin{cases} iL & \text{for non-overlapping frames} \\ i(L-K) & \text{for overlapping frames.} \end{cases}$$

where K is the number of samples overlapped between frames.

Now the compression (lossy encoding) process is a function which maps the speech frames, $\tilde{x}_i$, to parameters, $\theta_i$, and the decoding process maps back from the parameters, $\theta_i$, to an approximation of the original speech frames, $\hat{x}_i$. The speech frames that are produced by the decoder are not identical to the speech frames that were originally encoded. The codec is designed to produce output speech which is as perceptually similar as possible as the input speech, that is, the encoder must produce parameters which maximize some perceptual criterion measure between input speech frames and the frames produced by the decoder when processing the parameters.

Figure 3:
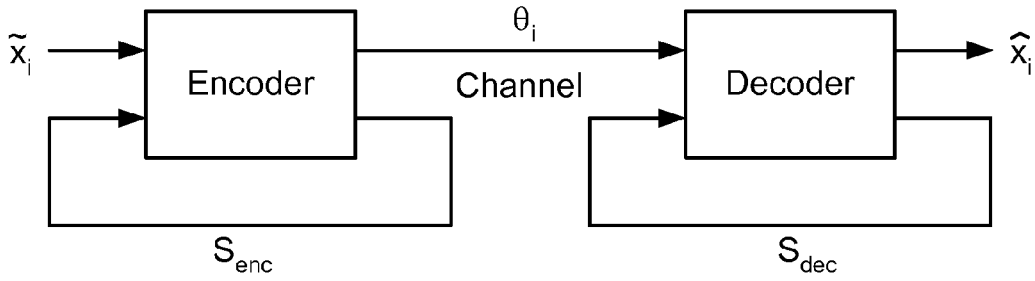
FIG. 3 PRIOR ART
FIG. 3 is a simplified block diagram showing a mathematical model of a codec.

In general the mapping from input to parameters, and from parameters to output, requires knowledge of all previous input or parameters. This can be achieved by maintaining state within the codec, S, for example in the construction of the adaptive codebook used by CELP based methods. The encoder state and decoder state must remain synchronized. This is achieved by only updating the state based on data which both sides (encoder and decoder) have, i.e. the parameters. FIG. 3 shows a generic model of an encoder, channel, and decoder.

The frame parameters, $\theta_i$, used in CELP-based models, consist of the linear-predictive coefficients (LPCs) used for short-term prediction of the speech signal (and physically relating to the vocal tract, mouth and nasal cavity, and lips), as well as excitation signal composed from adaptive and fixed codes. The adaptive codes are used to model long-term pitch information in the speech. The codes (adaptive and fixed) have associated codebooks that are predefined for a specific CELP codec. FIG. 1 shows a typical CELP decoder where the adaptive and fixed codebook vectors are scaled independently by a gain factor, then combined and filtered to produce synthesized speech. This speech is usually passed through a post-filter to remove artifacts introduced by the model.

Figure 2:
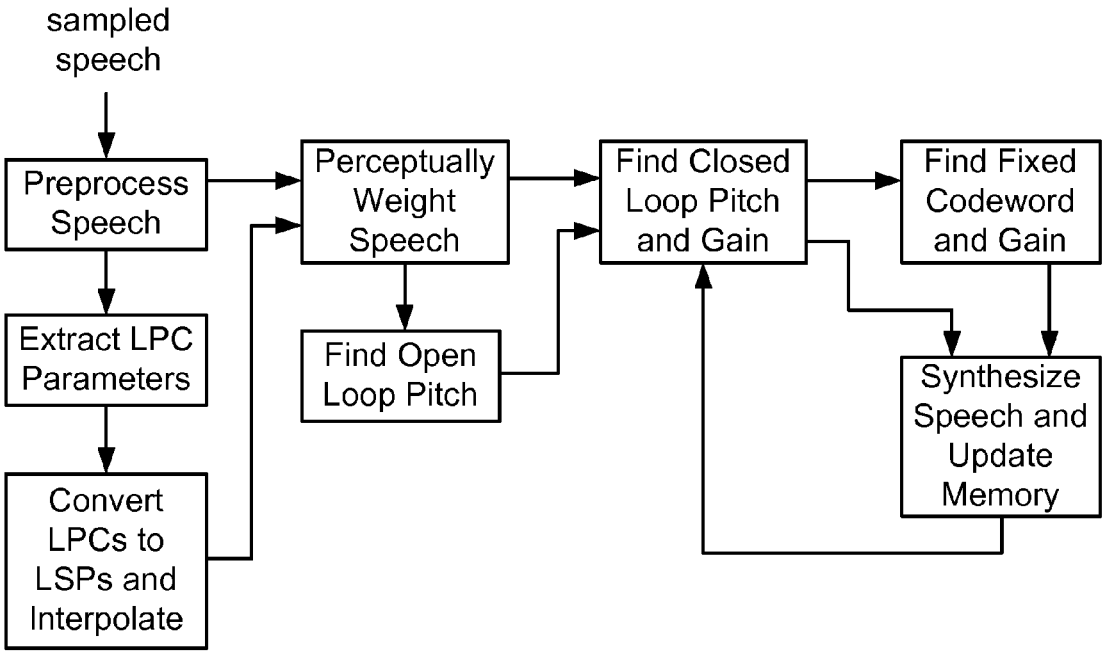
FIG. 2 PRIOR ART
FIG. 2 is a simplified block diagram of the encoder stage of a generic CELP coder.

The CELP encoding (analysis) process, shown in FIG. 2, involves preprocessing of the speech signal to remove unwanted frequency components and application of a windowing function, followed by extraction of the short-term LPC parameters. This is typically done using the Levinson-Durbin algorithm. The LPC parameters are converted into Line Spectral Pairs (LSPs) to facilitate quantization and subframe interpolation. The speech is then inverse-filtered by the short-term LPC filter to produce a residual excitation signal. This residual is perceptually weighted to improve quality and is analysed to find an estimate of the pitch of the speech. A closed-loop analysis-by-synthesis method is used to determine the optimal pitch. Once the pitch is found the adaptive codebook component of the excitation is subtracted from the residual, and the optimal fixed codeword found. The internal memory of the encoder is updated to reflect changes to the codec state (such as the adaptive codebook).

Figure 4:
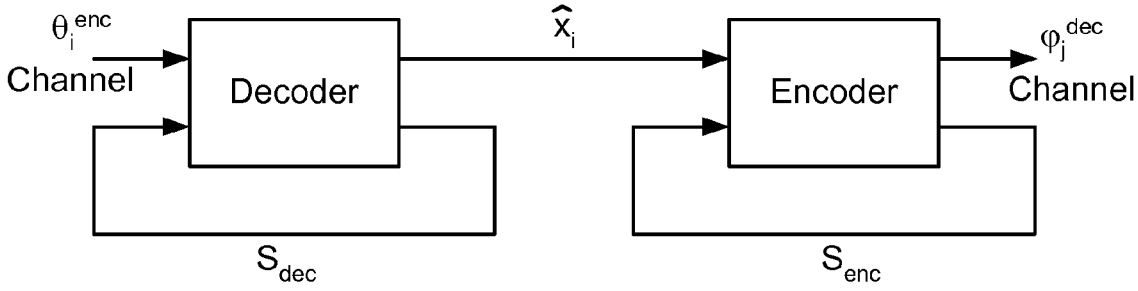
FIG. 4 PRIOR ART
FIG. 4 is a simplified block diagram showing a mathematical model of a tandem transcodec.

The simplest method of transcoding is a brute-force approach called tandem transcoding, see FIG. 4. This method performs a full decode of the incoming compressed bits to produce synthesized speech. The synthesized speech is then encoded for the target standard. This method suffers from the huge amount of computation required in re-encoding the signal, as well as from quality degradation issues introduced by pre- and post-filtering of the speech waveform, and from potential delays introduced by the look-ahead-requirements of the encoder.

Figure 5:
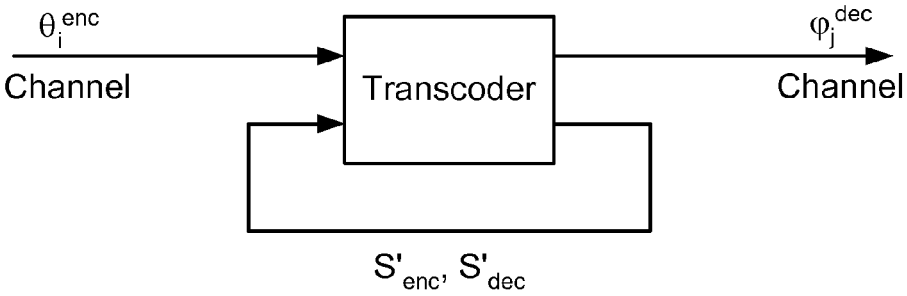
FIG. 5 PRIOR ART
FIG. 5 is a simplified block diagram showing a mathematical model of a smart transcodec.
Figure 6:
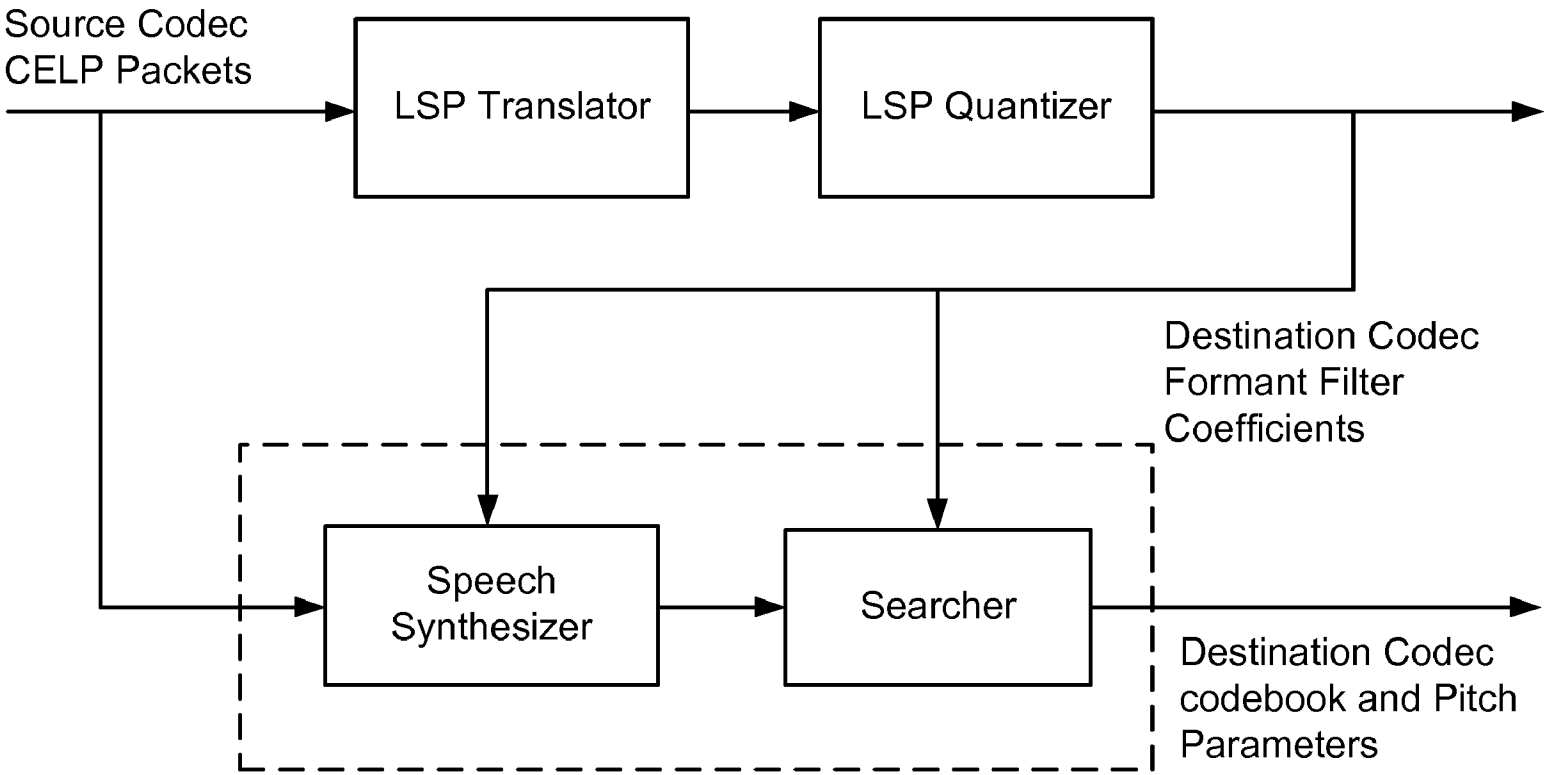
FIG. 6 PRIOR ART
FIG. 6 is an illustration of one of the traditional apparatus for CELP based transcoding.

Methods for "smart" transcoding similar to that illustrated in FIG. 5 have appeared in the literature. However these methods still essentially reconstruct the speech signal and then perform significant work to extract the various CELP parameters such as LPC and pitch. That is, these methods still operate in the speech signal space. In particular, the excitation signal which has already been optimally matched to the original speech by the far-end encoder (encoder at the far-end that has produced the compressed speech according to a compression format) is only used for the generation of the synthesised speech. The synthesised speech is then used to compute a new optimal excitation. Due to the requirement of incorporating impulse response filtering operations in closed-loop searches, this becomes a very computationally intensive operation. FIG. 6 illustrates the method used by U.S. Pat. No. 6,260,009 B 1. The reconstructed signal which is used as target signal by the Searcher is produced from the input excitation parameters and output quantized formant filter coefficients. Due to the differences between quantized formant filter coefficients in the source and destination codecs, this leads to degradation in the target signal for the Searcher and finally the output speech quality from the transcoding is significantly degraded. See FIG. 6. Other limitations may be found throughout the present specification and more particularly below.

Figure 7:
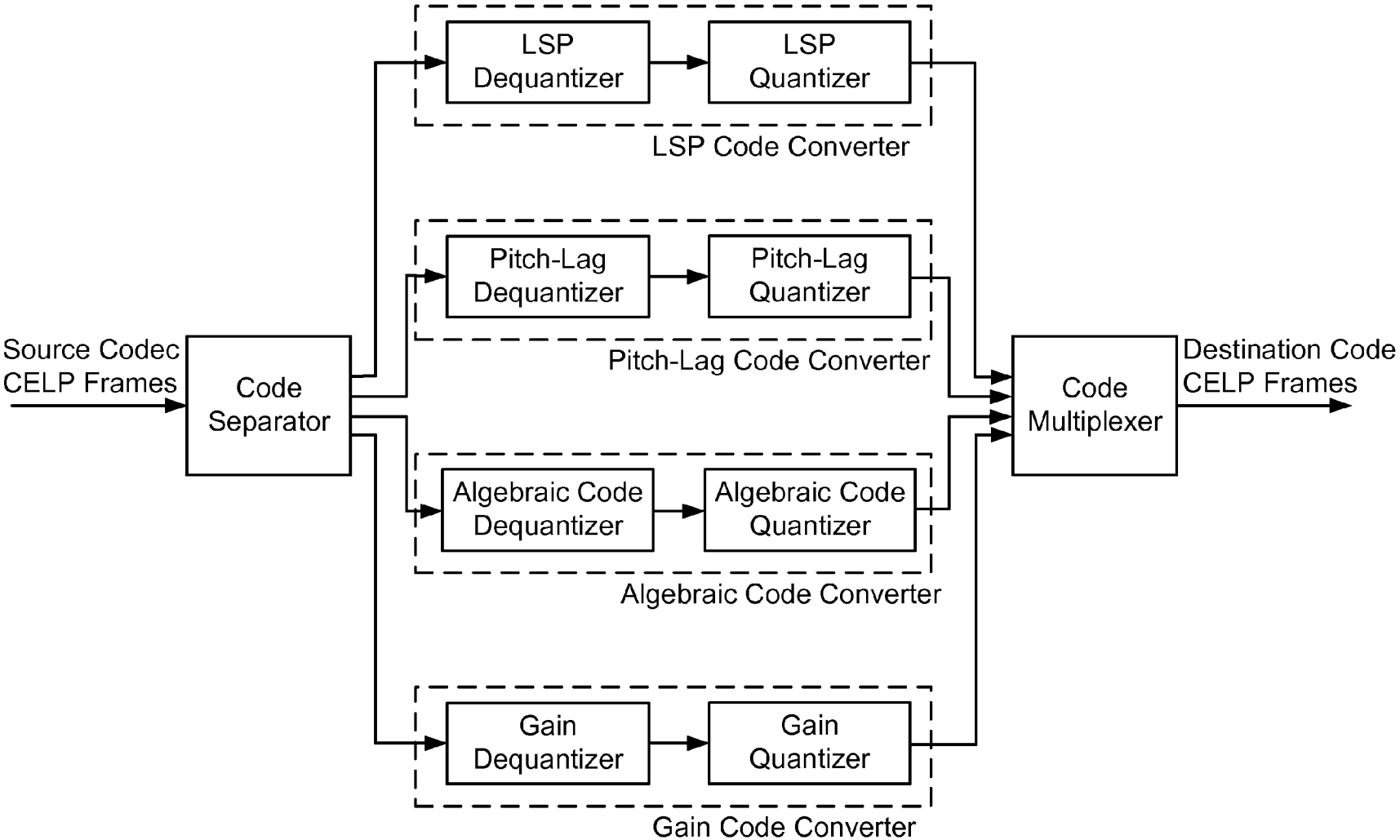
FIG. 7 PRIOR ART
FIG. 7 is an illustration of one of the traditional apparatus for CELP based transcoding.

Another "smart" transcoding method illustrated by FIG. 7. (US2002/0077812 A1) has been published. This method performs transcoding through mapping each CELP parameter directly ignoring the interaction between the CELP parameters. The method is only applicable for a special case that requires very restricted conditions between source and destination CELP codecs. For an example, it requires Algebraic CELP (ACELP) and same subframe size in both source and destination codecs. It does not produce good quality speech for most CELP based transcoding. This method is only suitable for one of the GSM-AMR modes and it doesn't cover all the modes in GSM-AMR.

A method and apparatus of the invention are discussed in detail below. In the following description, for purposes of explanation, numerous specific details are set forth in order to provide a thorough understanding of the present invention. The case of GSM-AMR and G.723.1 are used for illustration purpose and for examples. The methods described here are generic and apply to the transcoding between any pair of CELP codecs. A person skilled in the relevant art will recognize that other steps, configurations and arrangements can be used without departing from the spirit and scope of the present invention.

The invention covers the algorithms and methods used to perform smart transcoding between CELP-based speech coding standards. The invention also covers transcoding within a single standard in order to perform rate control (by transcoding to lower modes or introduce silence frames through an embedded Voice Activity Detector). The following sections discuss the details of the present invention.

Figure 8:
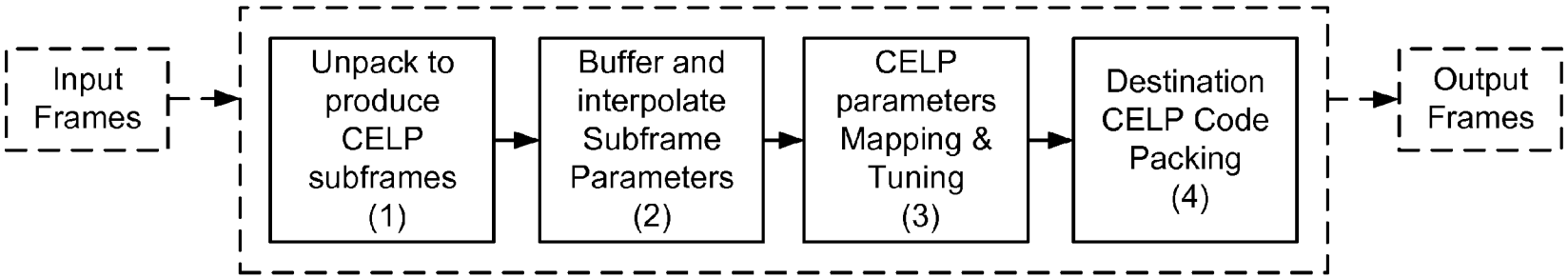
FIG. 8 is a simplified block diagram showing generic transcoding between CELP codecs.

The invention performs transcoding on a subframe by subframe basis. That is, as a frame is received by the transcoding system, the transcoder can begin operating on its subframes and producing output subframes. Once a sufficient number of subframes have been produced, a frame can be generated. If the duration of the frames defined by the source and destination standards are the same, then one input frame will produce one output frame, otherwise buffering of either input frames, or generation of multiple output frames will be needed. If the subframes are of different durations, then interpolation between the subframe parameters will be required. Thus the transcoding operation consists of four operations: (1) bitstream unpacking, (2) subframe buffering and interpolation of source CELP parameters, (3) mapping and tuning to destination CELP parameters, and (4) Code packing to produce output frame(s). (see FIG. 8).

Figure 10:
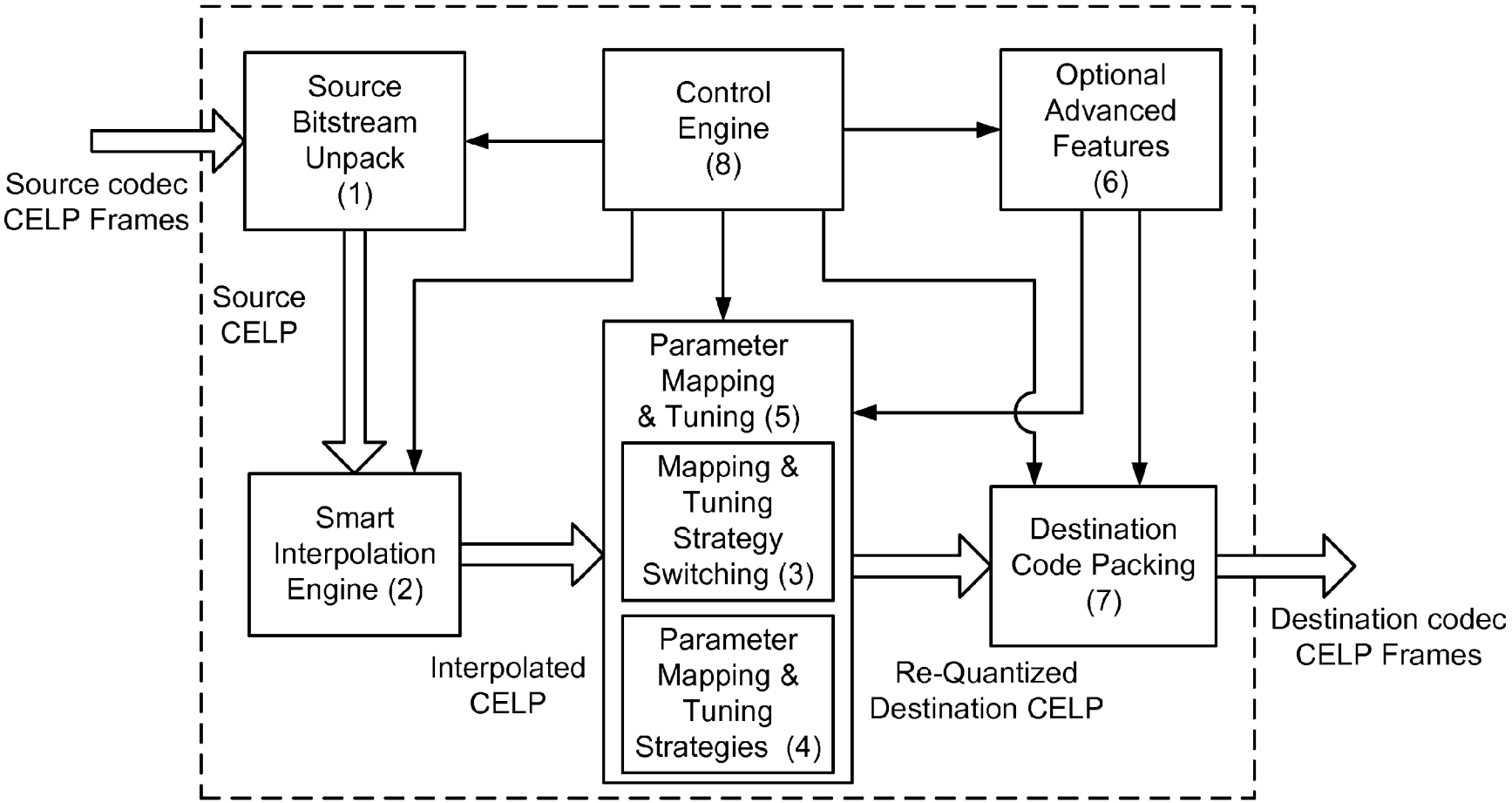
FIG. 10 depicts a simplified block diagram of a system constructed in accordance with an embodiment of the present invention to transcode an input CELP bitstream of from source CELP codec to an output CELP bitstream of destination codec.
Figure 11:
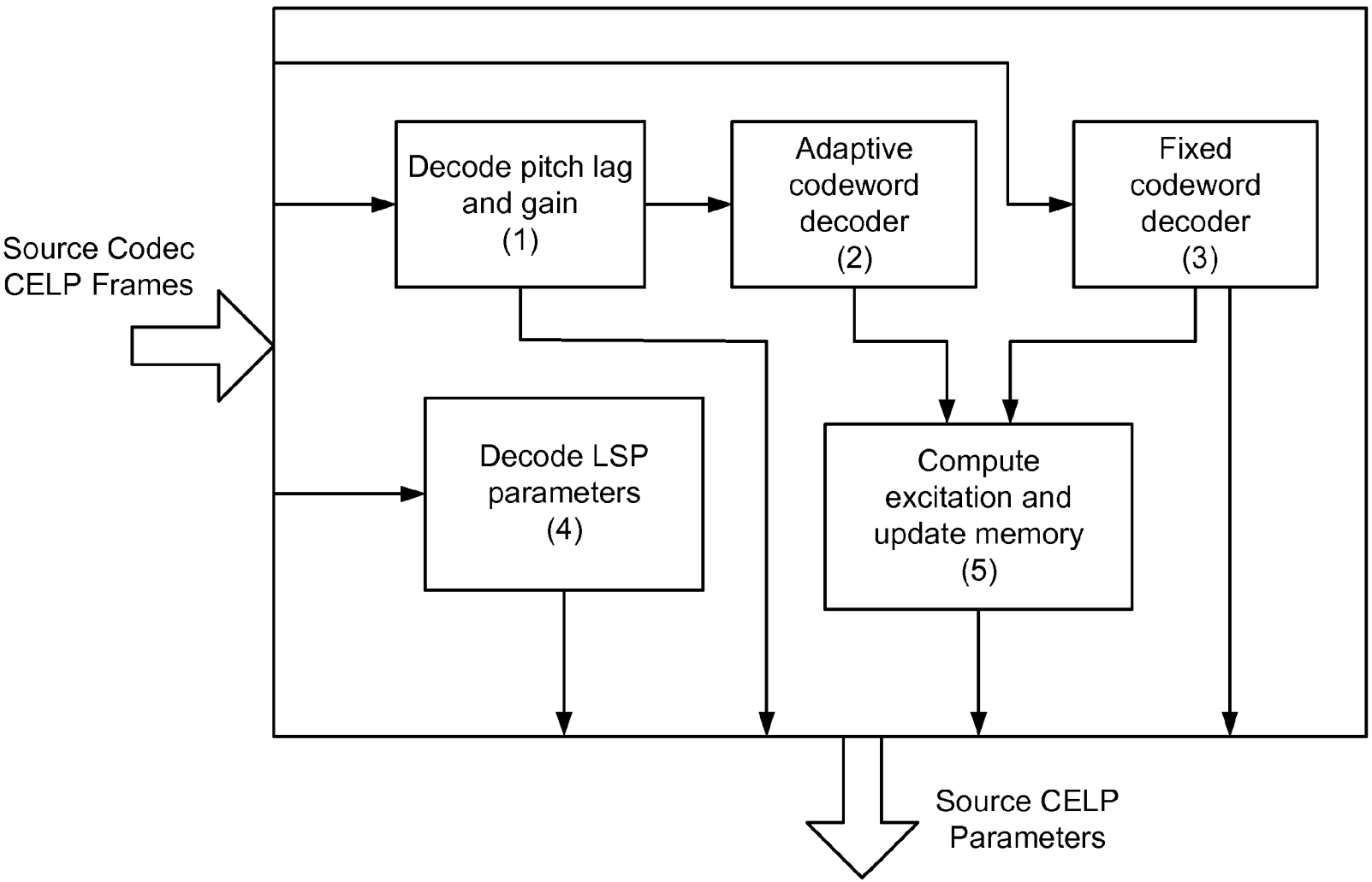
FIG. 11 is a simplified block diagram of a source codec CELP parameters unpack module in greater detail.

FIG. 10 is a block diagram illustrating the principles of a CELP based codec transcoding apparatus according to the present invention. The block comprises a source bitstream unpacking module, a smart interpolation engine, parameter mapping and tuning module, an optional advanced features module, a control module, and destination bitstream packing module.

The parameter mapping & tuning module comprises a mapping & tuning strategy switching module and parameter mapping & tuning strategies module.

The transcoding operation is overseen by the control module.

So on receipt of a frame, the transcoder unpacks the bitstream to produce the CELP parameters for each of the subframes contained within the frame. The parameters of interest are the LPC coefficients, the excitation (produced from the adaptive and fixed codewords), and the pitch lag.

Note that only decoding to the excitation is required, and not full synthesis of the speech waveform. This reduces the complexity of the source codec bitstream unpacking significantly. The codebook gains and fixed codewords are also of interest for CELP parameter Direct Space Mapping (DSM) transcoding strategy. If subframe interpolation is needed, it is done at this point.

Figure 14:
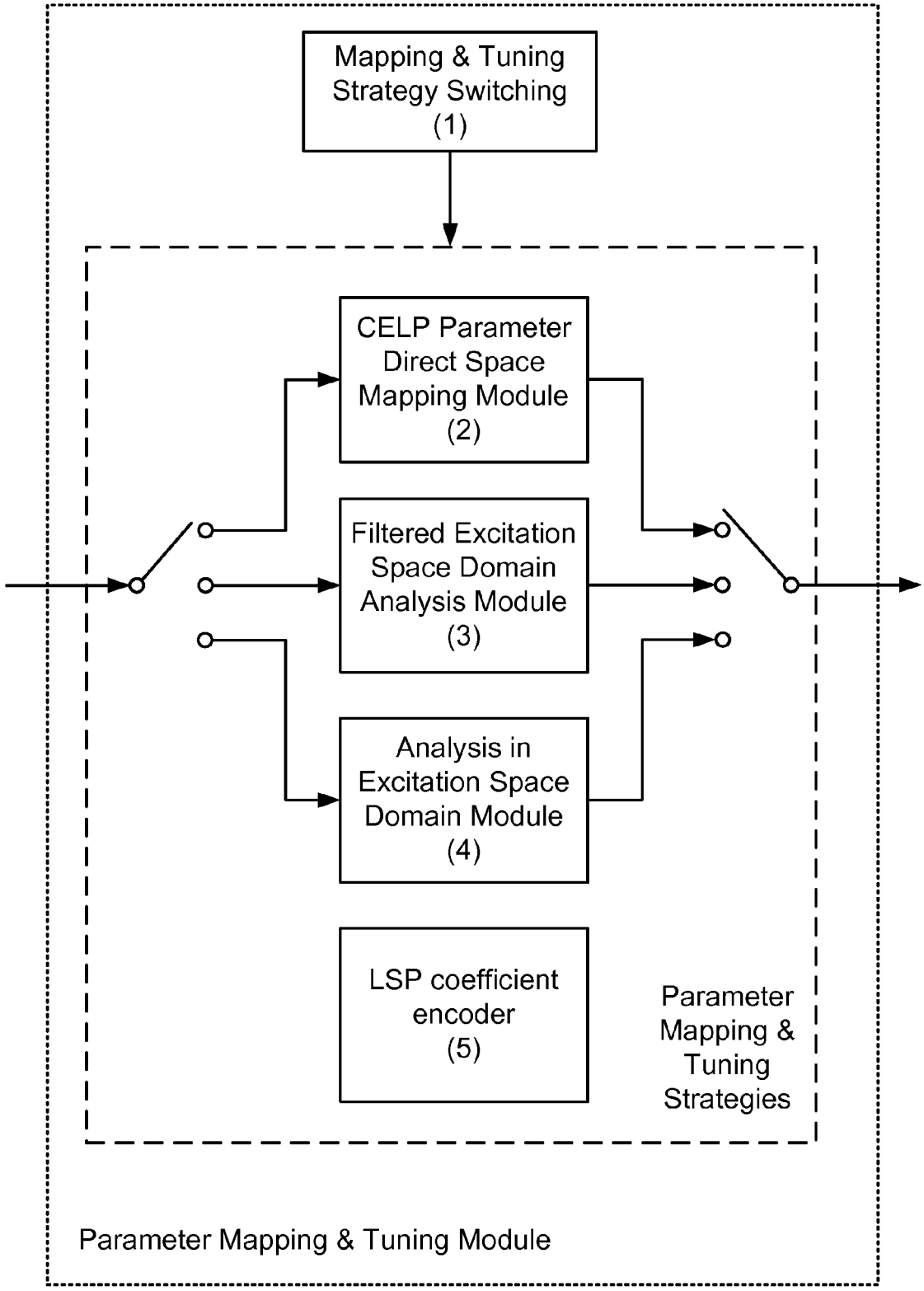
FIG. 14 is a simplified block diagram showing Parameter Mapping & Tuning Module for CELP parameter mapping in greater detail.
Figure 15:
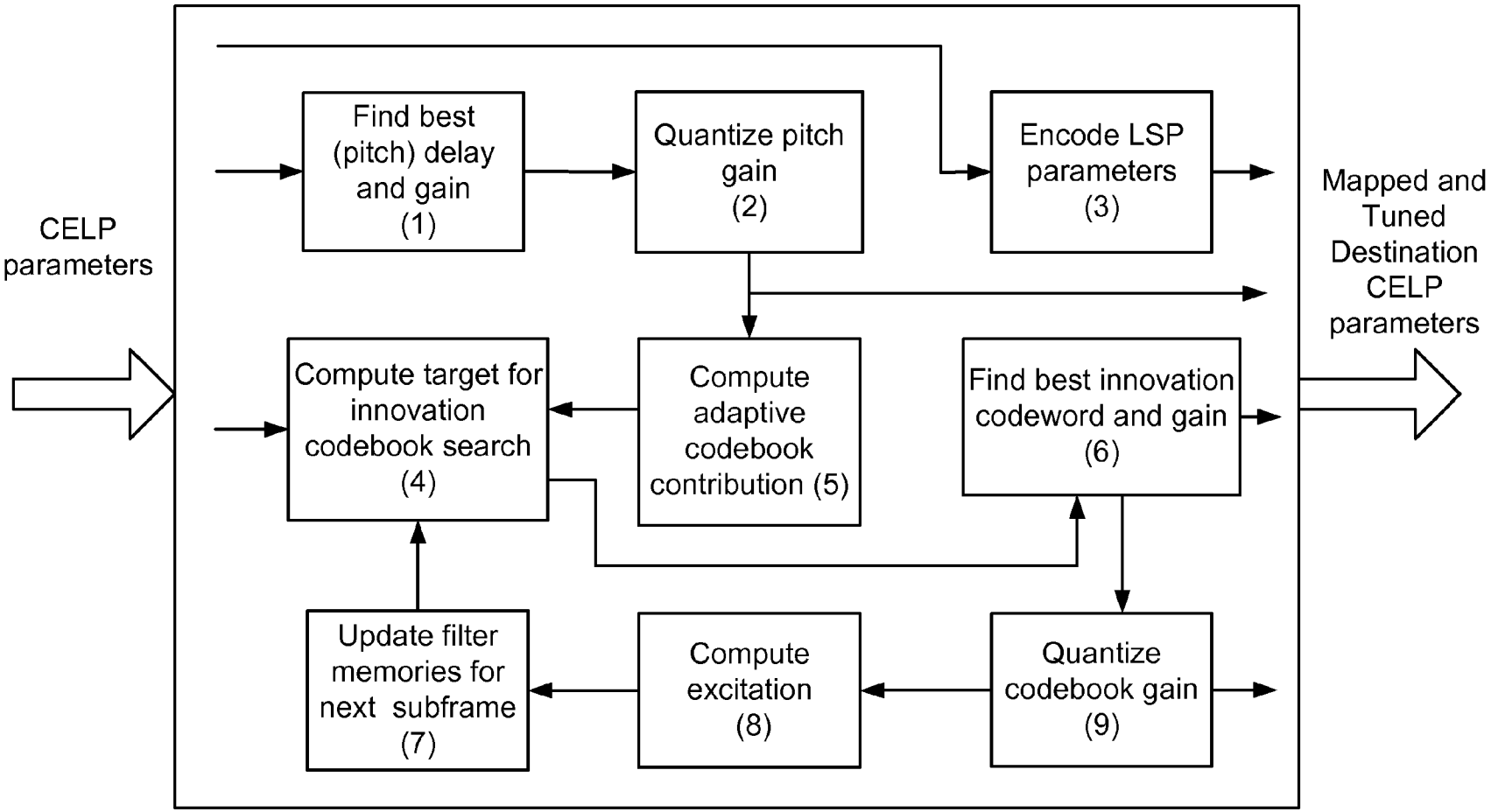
FIG. 15 is a simplified block diagram of a destination CELP parameters tuning module in greater detail.
Figure 16:
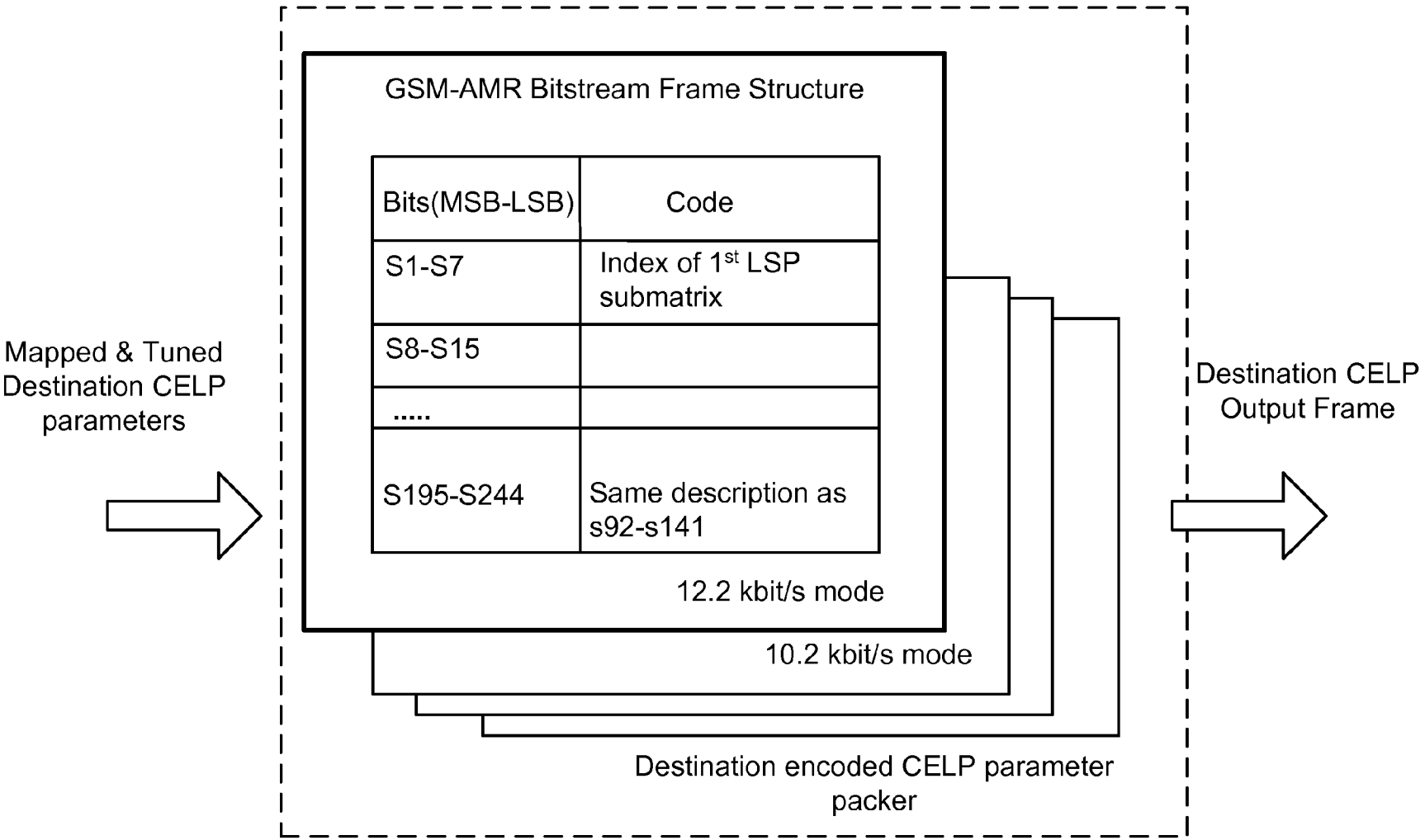
FIG. 16 is a simplified diagram showing an embodiment of the destination CELP code packing in frames for GSM-AMR.

The subframes are now in a form amenable for processing by the destination parameter mapping and tuning module shown in FIG. 14. The short-term LPC filter coefficients are mapped independently of the excitation CELP parameters. Simple linear mapping in the LSP pseudo-frequency space can be used to produce the LSP coefficients for the destination codec. More sophisticated non-linear interpolation can also be used. The excitation CELP parameters can be mapped in a number of ways giving accordingly better quality output at the cost of computational complexity. Three such mapping strategies have been described in this document and are part of the Parameter Mapping & Tuning Strategies module (FIG. 10, block (4)):

CELP parameter Direct Space Mapping (DSM);

Analysis in excitation space domain;

Analysis in filtered excitation space domain

The selection of the mapping and tuning strategy is through the Mapping & Tuning Strategy Switching Module (FIG. 10, block (3)).

These three methods are discussed in detail in the following sections. Since the three methods trade-off quality for reduced computational load, they can be used to provide graceful degradation in quality in the case of the apparatus being overloaded by a large number of simultaneous channels. Thus the performance of the transcoders can adapt the available resources. Alternatively a transcoding system may be built using one strategy only yielding a desired quality and performance. In such a case, the Mapping and Tuning Strategy Switching module (FIG. 10, Block (3)) would not be incorporated.

A voice activity detector (operating in the parameter space) can also be employed at this point, if applicable to the destination standard, to reduce the outbound bandwidth.

The outputs of parameter mapping and tuning module are destination CELP codec codes. They are packed into destination bitstream frames according to the codec CELP frame format. The packing process is needed to put the output bits into format that can be understood by destination CELP decoders. If the application is for storage, the destination CELP parameters could be packed or could be stored in an application specific format. The packing process could also be varied if the frames are to be transported according to a multimedia protocol, as for example bit scrambling is to be implemented in the packing process.

Furthermore, the apparatus of the present invention provides the capability of adding future optional signal processing functions or modules.

Subframe Interpolation

Subframe interpolation may be needed when subframes for different standards represent different time durations in the signal domain, or when a different sampling rate is used. For example G.723.1 uses frames of 30 ms duration (7.5 ms per subframe), and GSM-AMR uses frames of 20 ms duration (5 ms per subframe). This is shown pictorially in FIG. 9. Subframe interpolation is performed on two different types of parameters: (1) sample-by-sample parameters (such as excitation and codeword vectors), and (2) subframe parameters (such as LSP coefficients, and pitch lag estimates). The sample-by-sample parameters are mapped by considering their discrete time index and copying to the appropriate location in the target subframe. Up- or down-sampling may be required if different sample rates are used by the different CELP standards. The subframe parameters are interpolated by some interpolation function to produce a smoothed estimate of the parameters in the target subframe. A smart interpolation algorithm can improve the voice transcoding, not only in terms of computational performance, but more importantly in terms of voice quality. A simple interpolation function is the linear interpolator.

Figure 9:
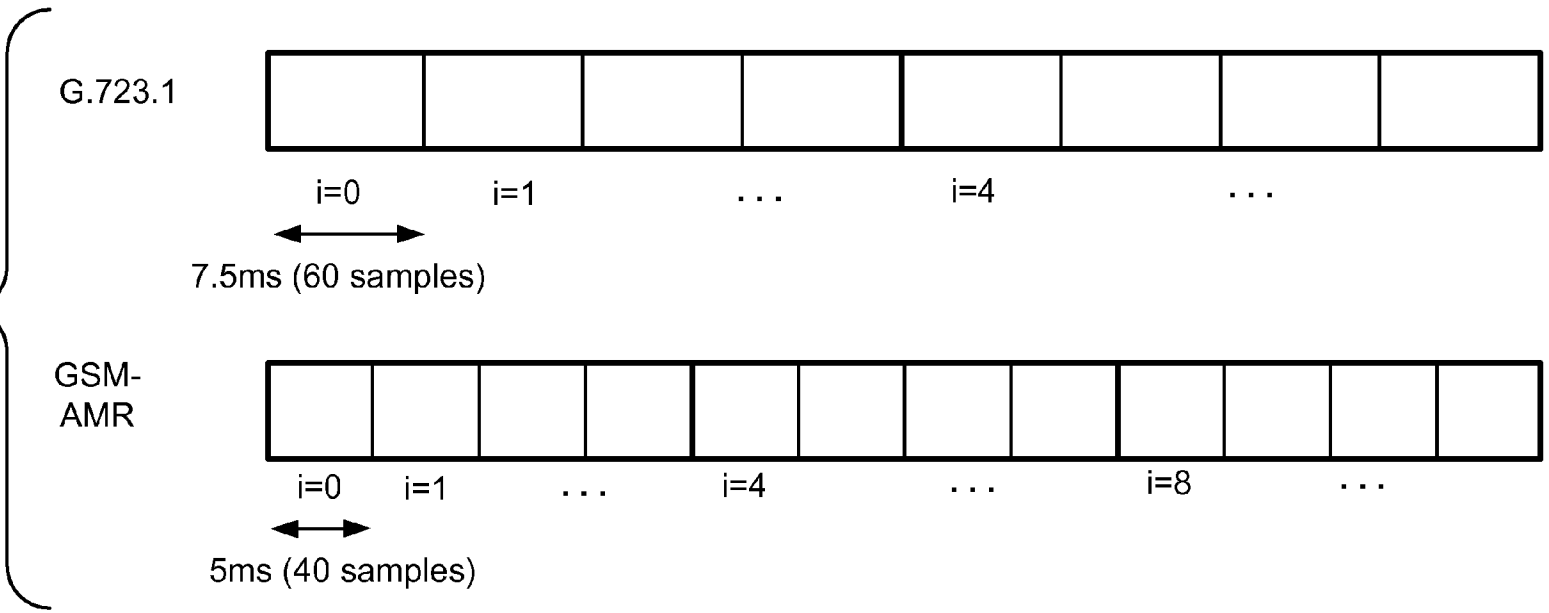
FIG. 9 is a simplified diagram showing subframe interpolation for GSM-AMR and G.723.1.
Figure 12:
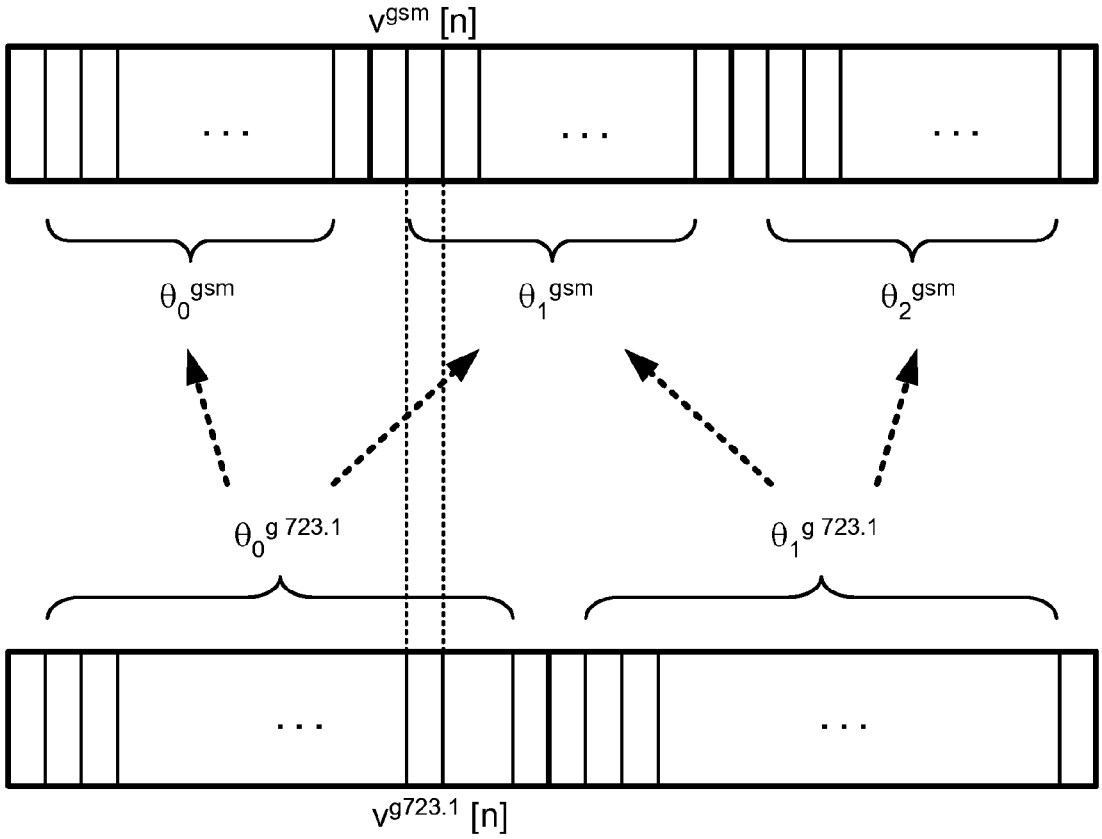
FIG. 12 is a simplified diagram showing interpolation of subframe and-sample-by-sample parameters for G.723.1 to GSM-AMR.

As an example, FIG. 9 shows that three GSM-AMR frames are needed to describe the same duration of speech signal as two G.723.1 frames. Likewise three GSM-AMR subframes are needed for every two G.723.1 subframes. As described above, there are two types of parameters: subframe-wide parameters (for example, the LSP coefficients) and sample-by-sample parameters (for example, the adaptive and fixed codewords). Subframe parameters, denoted $\theta$, are converted linearly, by calculating the weighted sum of overlapping subframes, and sample-by-sample parameters, denoted $v[\cdot]$, are formed by copying the appropriate samples. For interpolation to GSM-AMR subframes from G.723.1 subframes, the analytical formula is shown as following:

$$\theta_i^{gsm} = \theta_{\lfloor 2i/3 \rfloor}^{g.723.1} \qquad i \bmod 3 = 0,2$$

$$\theta_i^{gsm} = \frac{1}{2}\left(\theta_{\lfloor 2i/3 \rfloor}^{g.723.1} + \theta_{\lceil 2i/3 \rceil}^{g.723.1}\right) \qquad i \bmod 3 = 1$$

$$v_i^{gsm}[n] = v_{\lfloor (40i+n)/60 \rfloor}^{g.723.1}[(40i+n) \bmod 60] \quad \forall\, i, n$$

where i=0 is the first subframe of the first GSM-AMR frame, i=4 is the first subframe of the second GSM-AMR frame, etc. FIG. 12 depicts this process.

The LSP parameters, which are subframe-wide parameters should be interpolated in the pseudo-frequency domain, i.e. $f=\cos^{-1}(q)$. This results better quality output. The other subframe parameters do not need to be transformed before interpolating.

Note that the above analytical formula is derived from a simple linear interpolator. The formula can be replaced by any appropriate interpolation scheme, such as spline, sinusoidal, etc. Furthermore, each CELP parameter (LSP coefficients, lag, pitch gain, codeword gain and etc) can use different interpolation scheme to achieve best perceptual quality.

LSP Parameter Mapping and Excitation Vector Calibration by LSP Coefficients

Although almost all CELP based audio codecs make use of the same approaches to obtain LPC coefficients, there are still some minor differences. Theses differences are due to different window size and shape, different LPC interpolation for each subframes, different subframe sizes, different LPC quantisation schemes, and different look-up tables.

In order to further improve audio transcoding quality pr6dtzced through the subframe interpolation method described above, the excitation vectors used as target signals in transcoding are calibrated by applying LPC data from the source and destination codecs.

The following two methods can be employed to improve perceptual quality.

Method 1: Linear Transform of the LSP Coefficients

A generic method for converting between LSP coefficients is via a linear transform, $$q'=Aq+b$$

where q' is the destination LSP vector (in the pseudo-frequency domain), q is the source (original) LSP vector, A is a linear transform matrix and b is the bias term. In the simplest case, A reduces to the identity matrix and b reduces to zero. For the embodiment of the GSM-AMR to G.723.1 transcoder, the DC bias term used in the GSM-AMR codec is different from the one used by the G.723.1. codec, the b term in the equation above is used to compensate for difference.

Method 2: Excitation Vector Calibration by LSP Coefficients

Figure 13:
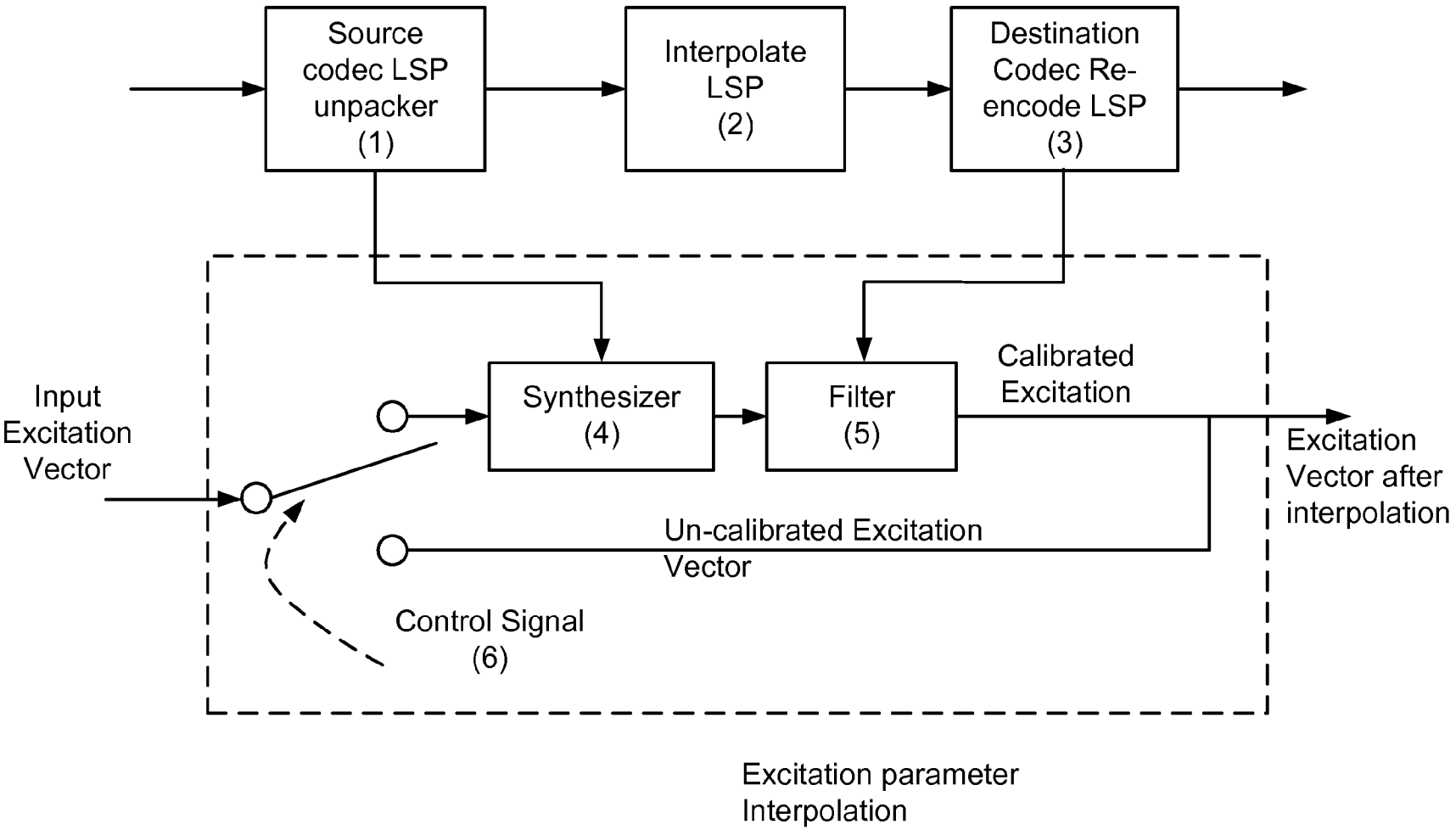
FIG. 13 is a simplified block diagram showing the excitation being calibrated by source codec LPC coefficients and destination codec encoded LPC coefficients.

The decoded source excitation vector is synthesized by source LPC coefficients in each subframes to convert to the speech domain and then filtered using quantized LP parameters of the destination codec to form the target signal in transcoding. This calibration is optional and it can significantly improve the perceptual speech quality where there is a marked difference in the LPC parameters. FIG. 13 depicts the excitation calibration approach.

Parameter Mapping & Tuning Module

This section discusses three strategies for mapping the CELP excitation parameters. They are presented in order of successive computational complexity and output quality. The core of the invention is the fact that the excitation can be mapped directly without the need to reconstruct the speech signal. This means that significant computation is saved during closed-loop codebook searches since the signals do not need to be filtered by the short-term impulse response, as required by conventional techniques. This mapping works because the incoming bitstream contains already optimal excitation according to the source CELP codec for generating the speech. The invention uses this fact to perform rapid searching in the excitation domain instead of the speech domain.

As mentioned previously, having three methods for excitation mapping, each with successively better performance, allows the transcoders to adapt to the available computation resources.

CELP Parameters Direct Space Mapping

This strategy is the simplest transcoding scheme. The mapping is based on similarities of physical meaning between source and destination parameters and the transcoding is performed directly using analytical formula without any iterating or searching. The advantage of this scheme is that it does not require a large amount of memory and consumes almost zero MIPS but it can still generate intelligible, albeit degraded quality, sound. Note that the CELP parameters direct space mapping method of the present invention is different to the apparatus of prior art showing in FIG. 7. This method is generic and it applies to all kind of CELP based transcoding in term of different frame or subframe size, different CELP codes in source and destination.

Analysis in Excitation Space Domain

This strategy is more advanced than the previous one in that both the adaptive and fixed codebooks are searched, and the gains estimated in the usual way defined by the destination CELP standard, except that they are done in the excitation domain, not the speech domain. The pitch contribution is determined first by local search using the pitch from the input CELP subframe as the initial estimate. Once found, the pitch contribution is subtracted from the excitation and the fixed codebook determined by optimally matching the residual. The advantage over the tandem approach is that the open-loop pitch estimate does not need to be calculated from the autocorrelation method used by the CELP standards, but can instead be determined from the pitch lag of the decoded CELP subframe. Also the search is performed in the excitation domain, not the speech domain, so that impulse response filtering during pitch and codebook searches is not required. This saves a significant amount of computation without compromising output quality.

Analysis in Filtered Excitation Space Domain

In this case, the LP parameters are still mapped directly from the source codec to the destination codec and the decoded pitch lag is used as the open-loop pitch estimation for the destination codec. The closed-loop pitch search is still performed in the excitation domain. However, the fixed-codebook search is performed in a filtered excitation space domain. The choice of the type of filter, and whether the target vector is converted to this domain for one or both searches, will depend on the desired quality and complexity requirements.

Various filters are applicable, including a lowpass filter to smooth irregularities, a filter that compensates for differences between characteristic of the excitation in the source and destination codecs, and a filter which enhances perceptually important signal features. An advantage is that unlike the computation of the target signal in standard encoding, which uses the weighted LP synthesis filter, the parameters of this filter (order, frequency emphasis/de-emphasis, phase) are completely tunable. Hence, this strategy allows for tuning to improve the quality for transcoding between a particular pair of codecs, as well as the provision to trade off quality for reduced complexity.

Silence Frame Transcoding and Generation

Some CELP-based standards implement Voice Activity Detectors (VAD) which allow discontinuous transmission (DTX) and comfort noise generation (CNG) during periods of no speech. There is a significant bit rate advantage in employing VAD. Transcoding between these frames is required, as well as generation of silence frames for destination codecs in the event of silence frames not being generated by the source codec. Usually the frames consist of parameters for generating the suitable comfort noise at the decoder. These parameters can be transcoded using simple algebraic methods.

Example Embodiments of the Invention

The following sections demonstrate embodiments of the invention for the G.723.1 and GSM-AMR speech coding standards. The invention is not limited to these standards. It covers all CELP-based audio coding standards. Anyone skilled in the art will recognize how to apply these methods to transcode between other CELP-based coding standards. Before describing preferred embodiments, a brief description of the GSM-AMR and G.723.1 codecs is first provided.

GSM-AMR Codec

The GSM-AMR codec uses eight source codecs with bit-rates of 12.2, 10.2, 7.95, 7.40, 6.70, 5.90, 5.15 and 4.75 kbit/s.

The codec is based on the code-excited linear predictive (CELP) coding model. A 10th order linear prediction (LP), or short-term, synthesis filter is used. The long-term, or pitch, synthesis filter is implemented using the so-called adaptive codebook approach.

In the CELP speech synthesis model, the excitation signal at the input of the short-term LP synthesis filter is constructed by adding two excitation vectors from adaptive and fixed (innovative) codebooks. The speech is synthesized by feeding the two properly chosen vectors from these codebooks through the short-term synthesis filter. The optimum excitation sequence in a codebook is chosen using an analysis-by-synthesis search procedure in which the error between the original and synthesized speech is minimized according to a perceptually weighted distortion measure. The perceptual weighting filter used in the analysis-by-synthesis search technique uses the unquantized LP parameters.

The coder operates on speech frames of 20 ms corresponding to 160 samples at the sampling frequency of 8000 sample/s. At each 160 speech samples, the speech signal is analysed to extract the parameters of the CELP model (LP filter coefficients, adaptive and fixed codebooks' indices and gains). These parameters are encoded and transmitted. At the decoder, these parameters are decoded and speech is synthesized by filtering the reconstructed excitation signal through the LP synthesis filter.

LP analysis is performed twice per frame for the 12.2 kbit/s mode and once for the other modes. For the 12.2 kbit/s mode, the two sets of LP parameters are converted to line spectrum pairs (LSP) and jointly quantized using split matrix quantization (SMQ) with 38 bits. For the other modes, the single set of LP parameters is converted to line spectrum pairs (LSP) and vector quantized using split vector quantization (SVQ).

The speech frame is divided into four subframes of 5 ms each (40 samples). The adaptive and fixed codebook parameters are transmitted every subframe. The quantized and unquantized LP parameters or their interpolated versions are used depending on the subframe. An open-loop pitch lag is estimated in every other subframe (except for the 5.15 and 4.75 kbit/s modes for which it is done once per frame) based on the perceptually weighted speech signal.

Then the following operations are repeated for each subframe:

- The target signal is computed by filtering the LP residual through the weighted synthesis filter with the initial states of the filters having been updated by filtering the error between LP residual and excitation (this is equivalent to the common approach of subtracting the zero input response of the weighted synthesis filter from the weighted speech signal).
- The impulse response of the weighted synthesis filter is computed.
- Closed-loop pitch analysis is then performed (to find the pitch lag and gain), using the target and impulse response, by searching around the open-loop pitch lag. Fractional pitch with ⅙th or ⅓rd of a sample resolution (depending on the mode) is used.
- The target signal is updated by removing the adaptive codebook contribution (filtered adaptive codevector), and this new target is used in the fixed algebraic codebook search (to find the optimum innovation codeword).
- The gains of the adaptive and fixed codebook are scalar quantified with 4 and 5 bits respectively or vector quantified with 6–7 bits (with moving average (MA) prediction applied to the fixed codebook gain).
- Finally, the filter memories are updated (using the determined excitation signal) for finding the target signal in the next subframe.

In each 20 ms speech frame, the bit allocation of 95, 103, 118, 134, 148, 159, 204 or 244 bits are produced, corresponding to a bit-rate of 4.75, 5.15, 5.90, 6.70, 7.40, 7.95, 10.2 or 12.2 kbps.

The G.723.1 Codec

The G.723.1 coder has two bit rates associated with it, 5.3 and 6.3 kbps. Both rates are a mandatory part of the encoder and decoder. It is possible to switch between the two rates on any 30 ms frame boundary.

The coder is based on the principles of linear prediction analysis-by-synthesis coding and attempts to minimize a perceptually weighted error signal. The encoder operates on blocks (frames) of 240 samples each. That is equal to 30 msec at an 8 kHz sampling rate. Each block is first high pass filtered to remove the DC component and then divided into four sub frames of 60 samples each. For every sub-frame, a 10th order linear prediction coder (LPC) filter is computed using the unprocessed input signal. The LPC filter for the last sub-frame is quantized using a Predictive Split Vector Quantizer (PSVQ). The unquantized LPC coefficients are used to construct the short term perceptual weighting filter, which is used to filter the entire frame and to obtain the perceptually weighted speech signal.

For every two sub-frames (120 samples), the open loop pitch period, $L_{OL}$, is computed using the weighted speech signal. This pitch estimation is performed on blocks of 120 samples. The pitch period is searched in the range from 18 to 142 samples.

From this point the speech is processed on a 60 samples per sub-frame basis.

Using the estimated pitch period computed previously, a harmonic noise shaping filter is constructed. The combination of the LPC synthesis filter, the formant perceptual weighting filter, and the harmonic noise shaping filter is used to create an impulse response. The impulse response is then used for further computations.

Using the pitch period estimation, $L_{OL}$, and the impulse response, a closed loop pitch predictor is computed. A fifth order pitch predictor is used. The pitch period is computed as a small differential value around the open loop pitch estimate. The contribution of the pitch predictor is then subtracted from the initial target vector. Both the pitch period and the differential value are transmitted to the decoder.

Finally the non periodic component of the excitation is approximated. For the high bit rate, multi-pulse maximum likelihood quantization (MP-MLQ) excitation is used, and for the low bit rate, an algebraic codebook excitation (ACELP) is used.

First Embodiment—GSM-AMR to 6.723.1

Figure 17:
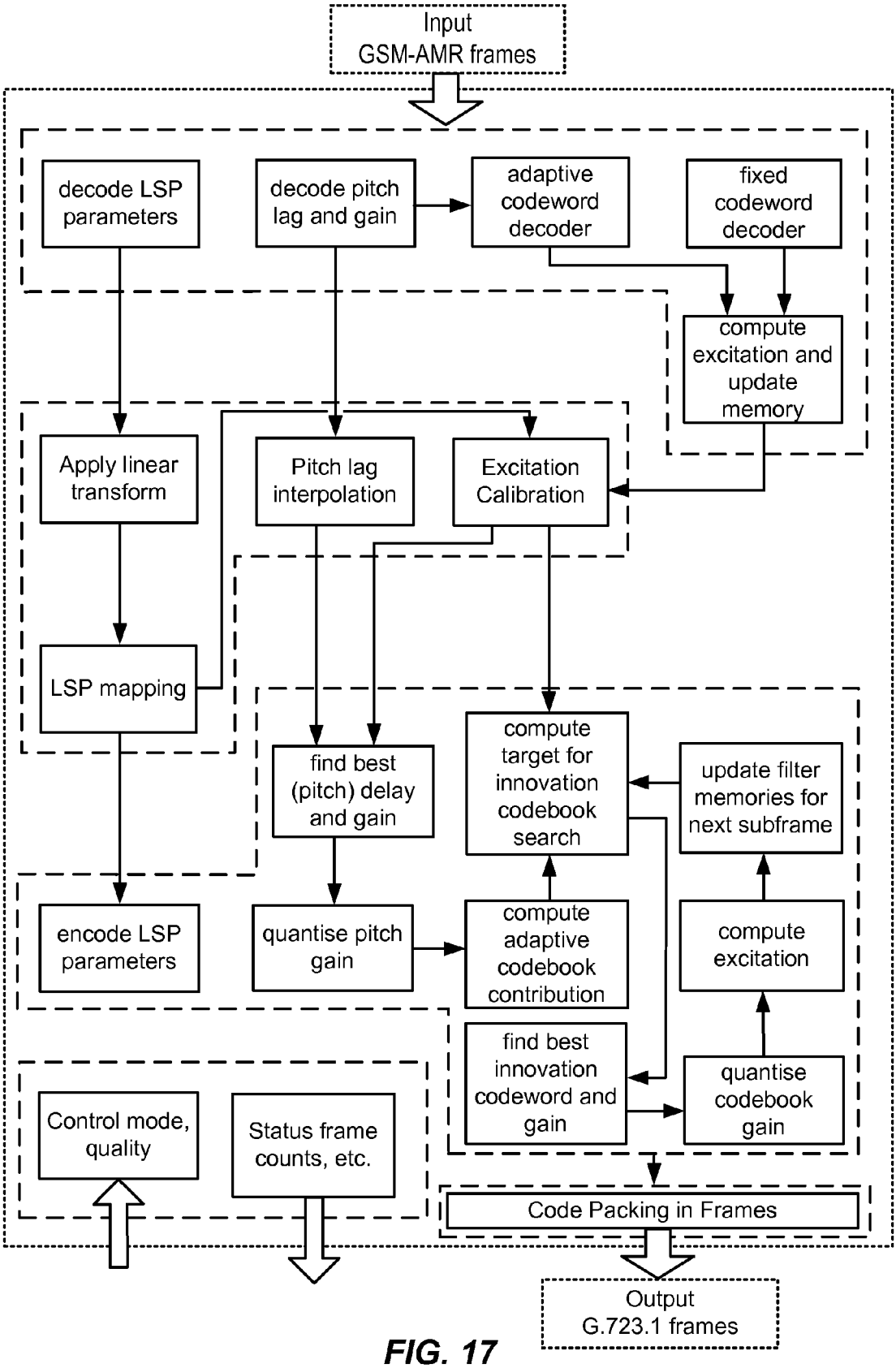
FIG. 17 depicts an embodiment of a G.723.1 to GSM-AMR transcoder.

FIG. 17 is a block diagram illustrating a transcoder from GSM-AMR to G.723.1 according to a first embodiment of the present invention. The GSM-AMR bitstream consists of 20 ms frames of length from 244 bits (31 bytes) for the highest rate mode 12.2 kbps, to 95 bits (12 bytes) for the lowest rate mode 4.75 kbps codec. There are eight modes in total. Each of the eight GSM-AMR operating modes produces different bitstreams. Since a G.723.1 frame, being 30 ms in duration, consists of one and a half GSM-AMR frames, two GSM-AMR frames are needed to produce a single G.723.1 frame. The next G.723.1 frame can then be produced on arrival of a third GSM-AMR frame. Thus two G.723.1 frames are produced for every three GSM-AMR frames processed.

The 10 LSP parameters used by the short-term filter in the GSM-AMR speech production model, are encoded using the same techniques, but in different bitstream formats for the different operating modes. The algorithm for reconstructing the LSP parameters is given in the GSM-AMR standard documentation.

Once the short-term filter parameters have been generated for each subframe, the excitation vector needs to be formed by combining the adaptive codeword and the fixed (algebraic) codeword. The adaptive codeword is constructed using a 60-tap interpolation filter based on $1/6^{th}$ or $1/3^{rd}$ resolution pitch lag parameter. The fixed codeword is then constructed as defined by the standard and the excitation formed as, $$x[n]=\hat{g}_p\, v[n]+\hat{g}_c c[n]$$

where x is the excitation, v is the interpolated adaptive codeword, c is the fixed codevector, and $\hat{g}_p$ and $\hat{g}_c$ are the adaptive and fixed code gains respectively. This excitation is then used to update the memory state of the GSM-AMR unpacker, and by the G.723.1 bitstream packer for mapping.

The adaptive codeword is found for each subframe by forming a linear combination of excitation vectors, and finding the optimal match to the target excitation signal, x[], constructed by the GSM-AMR unpacker. The combination is a weighted sum of the previous excitation at five successive lags. This is best explained via the equation, $$v[n] = \sum_{j=-2}^{2} \beta_j u[n-L+j], \quad 0 \le n \le 59$$

where v[] is the reconstructed adaptive codeword, u[] is the previous excitation buffer, L is the (integer) pitch lag between 18 and 143 inclusive (determined by from the GSM-AMR unpacking module), and the $\beta_j$ are lag weighting values which determine the gain and lag phase. The vector table of $\beta_j$ values is searched to optimize the match between the adaptive codeword, v[], and the excitation vector, x[].

Once the adaptive codebook component of the excitation is found, this component is subtracted from the excitation to leave a residual ready for encoding by the fixed codebook. The residual signal for each subframe is calculated as, $$x_2[n]=x[n]-v[n],\ n=0, \ldots, 59$$

where $x_2$[] is the target for the fixed codebook search, x[] is the excitation derived from the GSM-AMR unpacking, and v[] is the (interpolated and scaled) adaptive codeword.

The fixed codebooks are different for the high and low rate modes of the G.723.1 codec. The high rate uses an MP-MLQ codebook which allows six pulses per subframe for even subframes, and five pulses per subframe for odd subframes, in any position. The low rate mode uses an algebraic codebook (ACELP) which allows four pulses per subframe in restricted locations. Both codebooks use a grid flag to indicate whether to shift the codewords should be shifted by one position. These codebooks are searched by the methods defined in the standards, except that the impulse response filter is not used since the search is being performed in the excitation domain rather than the speech domain.

The (persistent) memory for the codec needs to be updated on completion of processing each subframe. This is done by first shifting the previous excitation buffer, u[], by 60 samples (i.e. one subframe), so that the oldest samples are discarded, and then copying the excitation from the current subframe into the top 60 samples of the buffer, $$u[n] = \begin{cases} u[n+60], & -85 \le n < 0 \\ \hat{g}_p v[n] + \hat{g}_c c[n], & 0 \le n \le 59 \end{cases}$$

where the index n is set relative to the first sample of the current subframe, and the other parameters have been defined previously.

All the mapped parameters are encoded into the outgoing G.723.1 bitstream, and the system is ready to process the next frame.

Second Embodiment—6.723.1 to GSM-AMR

Figure 18:
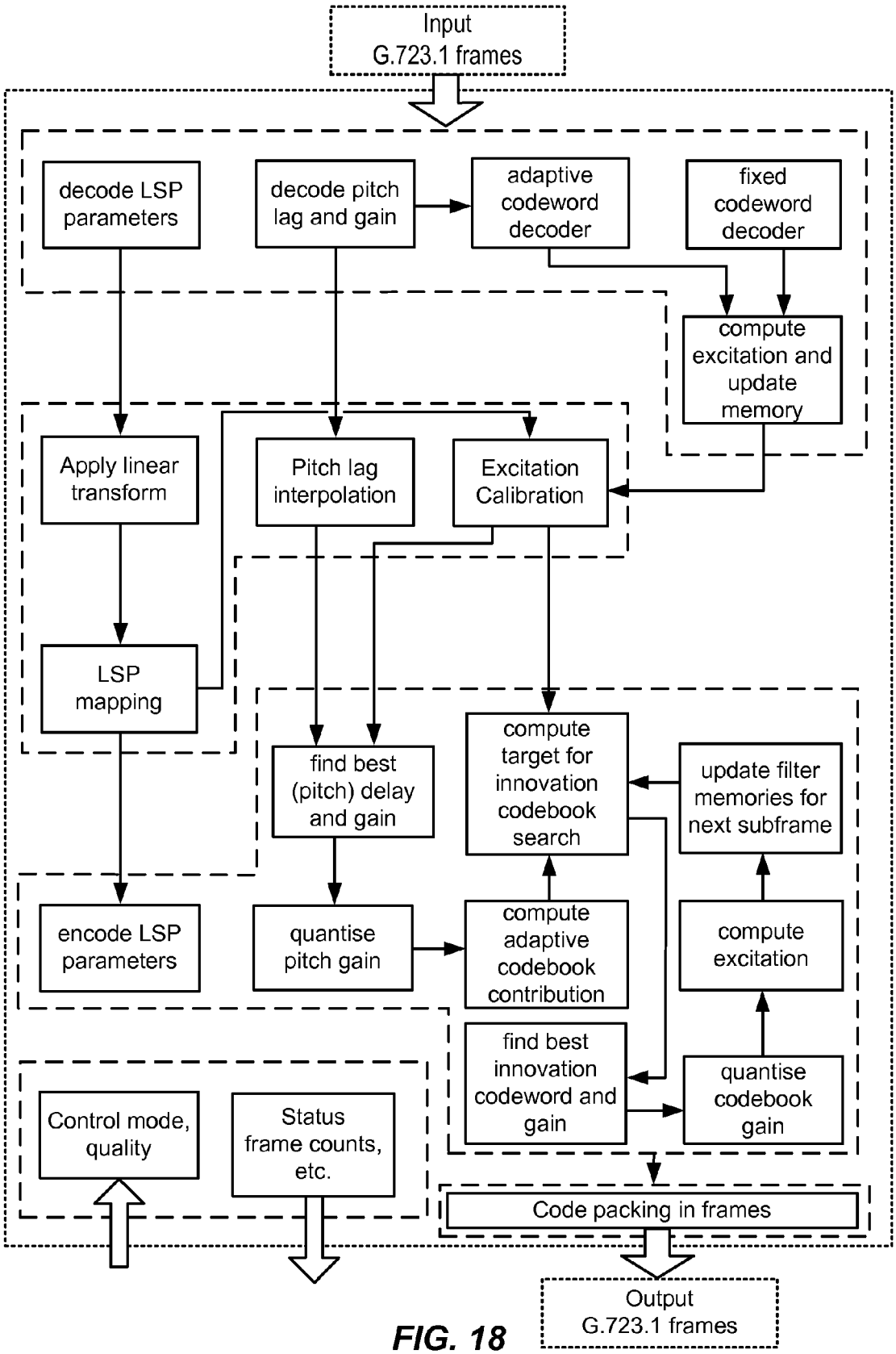
FIG. 18 depicts an embodiment of a GSM-AMR to G.723.1 transcoder.

FIG. 18 is a block diagram illustrating a transcoder of G.723.1 to GSM-AMR according to a second embodiment of the present invention. The G.723.1 bitstream consists of frames of length 192 bits (24 bytes) for the high rate (6.3 kbps) codec, or 160 bits (20 bytes) for the low rate (5.3 kbps) codec. The frames have a very similar structure and differ only in the fixed codebook parameter representation.

The 10 LSP parameters used for modeling the short-term vocal tract filter, are encoded in the same way for both high and low rates and can be extracted from bits 2 to 25 of the G.723.1 frame. Only the LSPs of the fourth subframe are encoded and interpolation between frames used to regenerate the LSPs for the other three subframes. The encoding uses three lookup tables and the LSP vector reconstructed by joining the three sub-vectors derived from these tables. Each table has 256 vector entries; the first two tables have 3-element sub-vectors, and last table has 4-element sub-vectors. Combined these give a 10-element LSP vector.

The adaptive codeword is constructed for each subframe by combining previous excitation vectors. The combination is a weighted sum of the previous excitation at five successive lags. This is best explained via the equation, $$v[n] = \sum_{j=-2}^{2} \beta_j u[n - L + j], \quad 0 \le n \le 59$$

where v[] f is the reconstructed adaptive codeword, u[] is the previous excitation buffer, L is the (integer) pitch lag between 18 and 143 inclusive, and the $\beta_j$ are lag weighting values determined by the pitch gain parameter.

The lag parameter, L, is extracted directly from the bitstream. The first and third subframes use the full dynamic range of the lag, whereas, the second and fourth subframes encode the lag as an offset from the previous subframe. The lag weighting parameters, $\beta_j$, are determined by table lookup. As a consequence of the adaptive codeword unpacking, an approximation to a fractional pitch lag and associated gain can be determined by calculating, $$L_i - \frac{\sum_{j=-2}^{2} j\beta_{i,j}^2}{\sum_{j=-2}^{2} \beta_{i,j}^2}$$

The fixed codebooks are different for the high and low rate modes of the G.723.1 codec. The high rate mode uses an MP-MLQ codebook which allows six pulses per subframe for even subframes, and five pulses per subframe for odd subframes, in any position. The low rate mode uses an algebraic codebook (ACELP) which allows four pulses per subframe in restricted locations. Both codebooks use a grid flag to indicate whether to shift the codewords should be shifted by one position. Algorithms for generating the codewords from the encoded bitstream are given in the G.723. 1 standard documentation.

The (persistent) memory for the codec needs to be updated on completion of processing each subframe. This is done by first shifting the previous excitation buffer, u[], by 60 samples (i.e. one subframe), so that the oldest samples are discarded, and then copying the excitation from the current subframe into the top 60 samples of the buffer, $$u[n] = \begin{cases} u[n+60], & -85 \le n < 0 \\ \hat{g}_p v[n] + \hat{g}_c c[n], & 0 \le n \le 59 \end{cases}$$

where the index n is set relative to the first sample of the current subframe, and the other parameters have been defined previously.

The GSM-AMR parameter mapping part of the transcoder takes the interpolated CELP parameters as explained above, and uses them as a basis for searching the GSM-AMR parameter space. The LSP parameters are simply encoded as received, whilst the other parameters, namely excitation and pitch lag, are used as estimates for a local search in the GSM-AMR space. The following figure shows the main operations which need to take place on each subframe in order to complete the transcoding.

The adaptive codeword is formed by searching the vector of previous excitations up to a maximum lag of 143 for a best match with the target excitation. The target excitation is determined from the interpolated subframes. The previous excitation can be interpolated by ⅙ or ⅓ intervals depending on the mode. The optimal lag is found by searching a small region about the pitch lag determined from the G.723.1 unpacking module. This region is searched to find the optimal integer lag, and then refined to determine the fractional part of the lag. The procedure uses a 24-tap interpolation filter to perform the fractional search. The first and third subframes are treated differently to the second and forth. The interpolated adaptive codeword, v[], is then formed as, $$v[n] = \sum_{i=0}^{9} u[n - L - i] b_{60}[t + 6i] + u[n - L + 1 + i] b_{60}[6 - t + 6i]$$

where u[] f is the previous excitation buffer, L is the (integer) pitch lag, t is the fractional pitch lag in $\frac{1}{6}^{th}$ resolution, and $b_{60}$ is the 60-tap interpolation filter.

The pitch gain is calculated and quantised so that it can be encoded and sent to the decoder, and also for calculation of the fixed codebook target vector. All modes calculate the pitch gain in the same way for each subframe, $$g_p = \frac{x^T v}{v^T v}$$

where $g_p$ is the unquantised pitch gain, x is the target for the adaptive codebook search, and v is the (interpolated) adaptive codeword vector. The 12.2 kbps and 7.95 kbps modes quantise the adaptive and fixed codebook gains independently, whereas the other modes use joint quantisation of the fixed and adaptive gains.

Once the adaptive codebook component of the excitation is found, this component is subtracted from the excitation to leave a residual ready for encoding by the fixed codebook. The residual signal for each subframe is calculated as, $$x_2[n] = x[n] - \hat{g}_p v[n], \; n = 0, \ldots, 39$$

where $x_2$[] is the target for the fixed codebook search, x[] is the target for the adaptive codebook search, $\hat{g}_p$ is the quantised pitch gain, and v[] is the (interpolated) adaptive.

The fixed codebook search is designed to find the best match to the residual signal after the adaptive codebook component has been removed. This is important for unvoiced speech and for priming of the adaptive codebook. The codebook search used in transcoding can be simpler than the one used in the codecs since a great deal of analysis of the original speech has already taken place. Also the signal on which the codebook search is performed is the reconstructed excitation signal instead of synthesized speech, and therefore already possesses a structure more amenable to fixed book coding.

The gain for the fixed codebook is quantised using a moving average prediction based on the energy of the previous four subframes. The correction factor between the actual and predicted gain is quantised (via-table lookup) and sent to the decoder. Exact details are given in the GSM-AMR standard documentation.

The (persistent) memory for the codec needs to be updated on completion of processing each subframe. This is done by first shifting the previous excitation buffer, u[], by 40 samples (i.e. one subframe), so that the oldest samples are discarded, and then copying the excitation from the current subframe into the top 40 samples of the buffer, $$u[n] = \begin{cases} u[n+40], & -114 \le n < 0 \\ \hat{g}_p v[n] + \hat{g}_c c[n], & 0 \le n \le 39 \end{cases}$$

where the index n is set relative to the first sample of the current subframe, and the other parameters have been defined previously.

While there has been illustrated and described what are presently considered to be example embodiments of the present invention, it will be understood by those skilled in the art that various other modifications may be made, and equivalents may be substituted, without departing from the true scope of the invention. Additionally, many modifications may be made to adapt a particular situation to the teachings of the present invention without departing from the central inventive concept described herein.

What is claimed is:

1. An apparatus for processing CELP-based frames comprising:

a first module for extracting one or more CELP parameters of a source codec;

a second module coupled to the first module, the second module being adapted to interpolate between one or more CELP parameters of the source codec and a destination codec, the one or more CELP parameters being selected from at least a frame size, a subframe size, and a sampling rate;

a third module coupled to the second module, the third module being adapted to map the one or more CELP parameters of the source codec to one or more CELP parameters of the destination codec;

a fourth module coupled to the third module, the fourth module being adapted to construct at least one destination output CELP frame based upon at least the one or more CELP parameters of the destination codec; and a controller coupled to at least the first module, the second module, the third module, and the fourth module, the controller being adapted to oversee an operation of one or more of the modules and being adapted to receive instructions from one or more external applications, the controller being adapted to provide a status information to one or more of the external applications;

wherein the first module is a single module or multiple modules.

2. The apparatus of claim 1 wherein the controller is a single controller or multiple controllers.

3. The apparatus of claim 1 wherein the first module and the second module are within the same module.

4. The apparatus of claim 1 wherein the second module is a single module or multiple modules.

5. The apparatus of claim 1 wherein the third module is a single module or multiple modules.

6. The apparatus of claim 1 wherein the fourth module is a single module or multiple modules.

7. An apparatus comprises:

a first module configured to determine one or more CELP parameters of a source codec;

a second module coupled to the first module, wherein the second module is configured to interpolate between the one or more CELP parameters of the source codec and one or more CELP parameters of a destination codec, wherein the one or more CELP parameters of the source code and the one or more CELP parameters of the destination codec are selected from a group consisting of: a frame size, a subframe size, and a sampling rate;

a third module coupled to the second module, wherein the third module is configured to map the one or more CELP parameters of the source codec to the one or more CELP parameters of the destination codec;

a fourth module coupled to the third module, wherein the fourth module is configured to form at least one destination output CELP frame in response to the one or more CELP parameters of the destination codec;

an advanced features module coupled to a module selected from a group consisting of: the first module, the second module, the third module, and the fourth module, wherein the advanced features module is configured to provide additional CELP-to-CELP transcoding; and a controller coupled to at least the first module, the second module, the third module, and the fourth module, the controller being adapted to oversee an operation of one or more of the modules and being adapted to receive instructions from one or more external applications, the controller being adapted to provide a status information to one or more of the external applications, wherein the first module is a single module or multiple modules.

8. The apparatus of claim 7 wherein the controller is a single controller or multiple controllers.

9. The apparatus of claim 7 wherein the first module and the second module are within the same module.

10. The apparatus of claim 7 wherein the fourth module is a single module or multiple modules.

11. The apparatus of claim 7 wherein the second module is a single module or multiple modules.

12. The apparatus of claim 7 wherein the third module is a single module or multiple modules.

13. The apparatus of claim 7 wherein the advanced features module comprises one or more modules.

14. The apparatus of claim 7 further comprising a module configured to perform a function selected from a group consisting of: comfort noise generation and discontinuous transmission.

15. The apparatus of claim 14 wherein the module performs transcoding using algebraic methods.

16. The apparatus of claim 7 further comprising a module configured to perform voice activity detection, and configured to generate silence frames.

* * * * *